US011225803B2

(12) United States Patent
Wang et al.

(10) Patent No.: US 11,225,803 B2
(45) Date of Patent: Jan. 18, 2022

(54) PRESTRESSED BAILEY BEAM FOR REINFORCEMENT AND CONSTRUCTION METHOD THEREFOR

(71) Applicant: CHANGSHA UNIVERSITY OF SCIENCE & TECHNOLOGY, Hunan (CN)

(72) Inventors: Lei Wang, Hunan (CN); Binghui Wu, Hunan (CN); Yafei Ma, Hunan (CN); Xuhui Zhang, Hunan (CN); Jianren Zhang, Hunan (CN)

(73) Assignee: CHANGSHA UNIVERSITY OF SCIENCE & TECHNOLOGY, Hunan (CN)

( * ) Notice: Subject to any disclaimer, the term of this patent is extended or adjusted under 35 U.S.C. 154(b) by 124 days.

(21) Appl. No.: 16/627,324

(22) PCT Filed: Jan. 15, 2019

(86) PCT No.: PCT/CN2019/071699
§ 371 (c)(1),
(2) Date: Dec. 29, 2019

(87) PCT Pub. No.: WO2019/137545
PCT Pub. Date: Jul. 18, 2019

(65) Prior Publication Data

US 2020/0141140 A1 May 7, 2020

(30) Foreign Application Priority Data

Jan. 12, 2018 (CN) ..... 201810029224.3

(51) Int. Cl.
*E04G 23/02* (2006.01)
*E01D 22/00* (2006.01)

(52) U.S. Cl.
CPC ..... *E04G 23/0218* (2013.01); *E01D 22/00* (2013.01)

(58) Field of Classification Search
CPC ..... E04G 23/0218; E04G 23/04; E01D 22/00; E01D 6/00; E01D 15/133; E01D 19/16;
(Continued)

(56) References Cited

U.S. PATENT DOCUMENTS 1,813,338 A * 7/1931 Botel ..... E04G 11/50 52/223.12
3,362,117 A * 1/1968 Van ..... E04C 3/292 52/223.12

(Continued)

FOREIGN PATENT DOCUMENTS

CN 202265780 6/2012
CN 102535355 7/2012

(Continued)

OTHER PUBLICATIONS

"International Search Report (Form PCT/ISA/210) of PCT/CN2019/071699", dated Apr. 19, 2019, with English translation thereof, pp. 1-5.

*Primary Examiner* — Theodore V Adamos
(74) *Attorney, Agent, or Firm* — JCIP Global Inc.

(57) ABSTRACT

A Bailey beam for reinforcement is composed of Bailey panels, stiffening rods, bolts, anchor bolts, a prestressing tendon and anchorages. The components of the Bailey beam are all prefabricated in a factory, and are assembled and hoisted on site. The prestressing tendon is arranged in a lower chord of the Bailey beam, and is anchored to the stiffening rods at both ends. The Bailey beam slides towards both ends during prestress tensioning. In this case, the Bailey beam is lifted as a whole, and the prestressing force is applied to a lower edge of the Bailey beam, resulting in an inverted arch of structure, closing up of cracks and a (Continued)

decrease in downward deflection. After the completion of the prestress tensioning, sealing is performed by fixing fillers, a sealing steel plate and injecting solidifiable materials.

11 Claims, 7 Drawing Sheets

(58) Field of Classification Search
CPC ..... E01D 2101/28; E01D 2101/24; E01D 2101/32; E04C 2003/0491; E04C 3/10; E04B 1/22
See application file for complete search history.

(56) References Cited

U.S. PATENT DOCUMENTS 3,587,125 A * 6/1971 McLeese ..... E04C 3/10 14/6
4,143,439 A * 3/1979 Fitzgerald-Smith ..... E01D 15/133 14/10
4,965,903 A * 10/1990 Bish ..... E01D 15/133 14/14
6,539,571 B1 * 4/2003 Forsyth ..... E01D 6/00 14/13
7,360,341 B2 * 4/2008 Jackson ..... E04G 11/50 52/645
8,621,797 B2 * 1/2014 Kim ..... E04C 5/08 52/223.8
2006/0236644 A1 * 10/2006 Bush ..... E04C 3/005 52/634
2012/0180407 A1 * 7/2012 Rees ..... E04G 23/0218 52/173.3
2016/0145815 A1 * 5/2016 Motavalli ..... E04C 5/085 52/126.1
2017/0101748 A1 * 4/2017 Thrall ..... E01D 6/00

FOREIGN PATENT DOCUMENTS

CN 105887702 8/2016
CN 206267560 6/2017
CN 108103965 6/2018
KR 100664698 1/2007
KR 20120015197 2/2012

* cited by examiner

PRESTRESSED BAILEY BEAM FOR REINFORCEMENT AND CONSTRUCTION METHOD THEREFOR

CROSS-REFERENCE TO RELATED APPLICATION

This application is a 371 of international application of PCT application serial no. PCT/CN2019/071699, filed on Jan. 15, 2019, which claims the priority benefit of China application no. 201810029224.3, filed on Jan. 12, 2018. The entirety of each of the above mentioned patent applications is hereby incorporated by reference herein and made a part of this specification.

BACKGROUND

Technical Field

The invention relates to the field of reinforcement for bridges and architectural structures, and in detail, to a prestressed Bailey beam for reinforcement and a corresponding construction method.

Description of Related Art

With the rapid development of China's economy, the public infrastructure construction has grown very fast. Particularly, since 1990s, China has been investing heavily on high-grade highways, strongly promoting the development of bridge construction in China and rapidly increasing the quantity of bridges, most of which are concrete structures. The existing concrete structures in service, however, appear to be insufficient in bearing capacity and stiffness due to the following reasons, including invasion of harmful medium in the external environment, concrete aging and cracking, defects in design and construction, change of usage function, overloading, improvement of design standards, etc. The existing structures, therefore, need to be maintained and reinforced to ensure their safety under normal service conditions.

Currently, several methods have been used for common reinforcement of structures. These methods include section enlargement, external prestressing, bonding steel plate, bonding FRP reinforcement, etc. The section enlargement method increases the sectional area and self-weight of the structure, and requires also a complicated construction process and long construction period. The bonding steel plate method and the bonding FRP reinforcement method enhance the bearing capacity by bonding the steel plates or FRP on the surface of the structure. The steel plates and FRP, however, are easy to peel off and have poor durability due to the limitation of adhesive materials and technological level. For the external prestressing method, application of additional prestressing may cause local cracking of the concrete structure. In addition, this method requires a relatively complicated construction process. Therefore, a highly effective reinforcement method, which owns the properties such as easy and convenient construction, short construction period, great durability, low interrupt in traffic, and a relatively small structure size and self-weight, should have a broad application prospect.

SUMMARY

To solve the defects in the existing reinforcement methods, a prestressed Bailey beam for reinforcement and a corresponding construction method are proposed in the present invention. This reinforcement method integrates the ideas of composite structures, assembly concept and lever principle. Combination of Bailey beam and prestressing force improves the stiffness, bearing capacity and durability of the structure. In addition, this method enables the reinforced structure to form an inverted arch, reduce downward deflection, closes cracks. As a result, the anti-cracking performance of the structure can be highly improved.

To implement the foregoing technical objective, the solution provided in the invention is shown as follows.

A prestressed Bailey beam for reinforcement, including Bailey panels, anchor bolts, two stiffening rods, bolts, nuts, a prestressing tendon, a tensioning end anchorage, and a fixing end anchorage, is provided. The Bailey panels include a front Bailey panel, an end Bailey panel, and a middle Bailey panel set. All Bailey panels are linked end-to-end in sequence. The front Bailey panel and the end Bailey panel are installed on both ends of the prestressed Bailey beam, respectively. The middle Bailey panel set is installed between the front Bailey panel and the end Bailey panel, and has n pairs of Bailey panels, where n is a natural number. Several elongated sliding grooves are provided at both an upper chord and a lower chord of each Bailey panel. The anchor bolts pass through the elongated sliding grooves and are fixed on the structure to be strengthened. The two stiffening rods are disposed on the front Bailey panel and the end Bailey panel, respectively. One of the stiffening rod ends is connected to the upper chord of the Bailey panel through a bolt. The anchor bolts pass through a central position of the stiffening rod and are fixed on the structure to be strengthened. In doing so, this anchor bolt can be used as a fulcrum for the stiffening rod to rotate. An anchorage is disposed at the other end of the stiffening rod. The prestressing tendon passes through the two anchorages. The nuts are screwed into the anchor bolts and are tightened to fix the positions of the Bailey panels after completion of prestressing tendon tensioning.

In the prestressed Bailey beam for reinforcement, a cylinder is disposed on the stiffening rod at the end where the anchorage is disposed. For the cylinder, an elongated prestressing tendon groove running through the entire cylinder is formed in a diameter direction of a cross section. The anchorage is attached on a side wall of the cylinder by an acting force of the prestressing tendon. The prestressing tendon passes through the prestressing tendon grooves on the cylinders.

In the prestressed Bailey beam for reinforcement, a one side-open prestressing groove, which is used to accommodate the prestressing tendon, is formed at the bottom of the lower chord of the Bailey panel.

The prestressed Bailey beam for reinforcement also includes a sealing steel plate and a solidifiable material. The size of the sealing steel plate matches the size of the prestressing groove opening. After the tensioning of the prestressing tendon is completed, the sealing steel plate is fixed on the opening of the prestressing groove, so that the prestressing groove is turned into a tubular structure and the solidifiable material is injected into the prestressing groove of the tubular structure and is solidified thereinside.

In the prestressed Bailey beam for reinforcement, the solidifiable material is cement paste or a structural adhesive.

The Bailey beam is installed on two sides of the structure to be strengthened, and the two Bailey beams on the two sides are symmetrically installed. The anchor bolts pass through the structure to be strengthened and are used to fix the Bailey beams on the two sides.

In the prestressed Bailey beam for reinforcement, two Bailey panels located at a central position of the middle Bailey panel set are respectively provided with female ends and male ends in a prestress stretching direction on a connecting side of the two Bailey panels for mutual connection. The female ends are formed on the upper chord and the lower chord of one of the two Bailey panels. The male ends are formed on the upper chord and the lower chord of the other Bailey panel. The female end and the corresponding male end are overlapped and are provided with overlapping elongated sliding grooves for the anchor bolt to pass through.

In the prestressed Bailey beam for reinforcement, aside from the connection part of the two Bailey panels located at the central position, any two neighboring Bailey panels are respectively provided with female ends and male ends in the prestress stretching direction on a connecting side of the two neighboring Bailey panels for mutual connection. The female ends are formed on the upper chord and the lower chord of one of the two neighboring Bailey panels. The male ends are formed on the upper chord and the lower chord of the other Bailey panel. The female end and the corresponding male end are overlapped and are provided with overlapping fixing holes for a bolt to pass through to fixedly connect the two neighboring Bailey panels.

The prestressed Bailey beam for reinforcement further includes fillers in a same shape as the upper chord and the lower chord. A gap is reserved between the stiffening rod and the lower chord of the front Bailey panel, a gap is reserved respectively between the stiffening rod and the lower chord of the end Bailey panel. After completion of the prestressing tendon tensioning, a filler is fixed between the stiffening rod and the lower chord of the front Bailey panel, and a filler is fixed between the stiffening rod and the lower chord of the end Bailey panel. In addition, there is a gap stretching between the female end and the male end of the two Bailey panels located at the central position. A filler is also fixed in the gap.

A construction method of the prestressed Bailey beam for reinforcement is provided, where the prestressed Bailey beam for reinforcement described above is used and the method includes the following steps.

Step 1: Determining positions of anchor bolts on a surface of a concrete structure, drilling holes and inserting the anchor bolts.

Step 2: Hoisting and mounting the Bailey panels and the stiffening rods to the positions of the anchor bolts; and screwing the nuts into the anchor bolts while ensuring that the stiffening rods can rotate and the Bailey panels can slide towards both ends during prestress tensioning.

Step 3: Passing a prestressing tendon through a cylinder on one end of a stiffening rod, a lower chord of the Bailey panel, and a cylinder on the other end of the stiffening rod, in sequence; performing tensioning on the prestressing tendon by using tension equipment; and after the tensioning is completed, tightening the nuts to fix the stiffening rods and the Bailey panels, and anchoring the prestressing tendon onto the cylinders on the stiffening rods by using a tensioning end anchorage and a fixing end anchorage.

Step 4: After the prestress tensioning is completed, fixing a filler between the stiffening rod and the lower chord of a front Bailey panel, fixing a filler between the stiffening rod and the lower chord of an end Bailey panel, and fixing a filler between female ends and male ends of two Bailey panels located at a central position so as to make the Bailey panels and the stiffening rods a fixed whole; and fixing a sealing steel plate on an opening of a prestressing groove so as to form a sealed rectangular steel tube.

Step 5: Injecting a solidifiable material into the steel tube.

The technical effect of the invention is that, during the prestress tensioning, the stiffening rod acts as a lever to rotate around the anchor bolt, transmit the prestress to the Bailey beam and drive the Bailey beam to slide towards both ends, and then turns the prestress into a vertical force and transmit the vertical force to the structure through the anchor bolts, so that the structure has an inverted arch, reduces downward deflection and closes cracks. After the prestress tensioning is completed, the fillers and the sealing steel plates are fixed and the solidifiable material is injected so that the Bailey beam and the prestressing tendon are made into a composite structure of the prestressed concrete filled steel-tubular. In this case, the Bailey beam and the prestressing tendon bear weight jointly, a prestress loss is reduced, and the prestressing tendon is protected. The prestressed Bailey beam makes full use of the advantages of the Bailey beam and the external prestressing. The Bailey beam bears weight in a simple and clear manner, and adds little self-weight, thereby substantially enhancing stiffness, bearing capacity, anti-cracking ability, and durability of the structure. In addition, the Bailey beam is located at both sides of the structure for reinforcement and therefore does not affect the clearance under the bridge. The reinforcement method is based on the lever principle, and adopts the idea of composite structures and the assembly concept. This method is easy and quick in construction, and the traffic is not interrupted. In this case, the structure can be reinforced as a whole, or a region of the structure can be locally reinforced. Therefore, the Bailey beam can be widely used in the reinforcement of concrete structures.

The invention is further described below with reference to the accompanying drawings.

Figure 1:
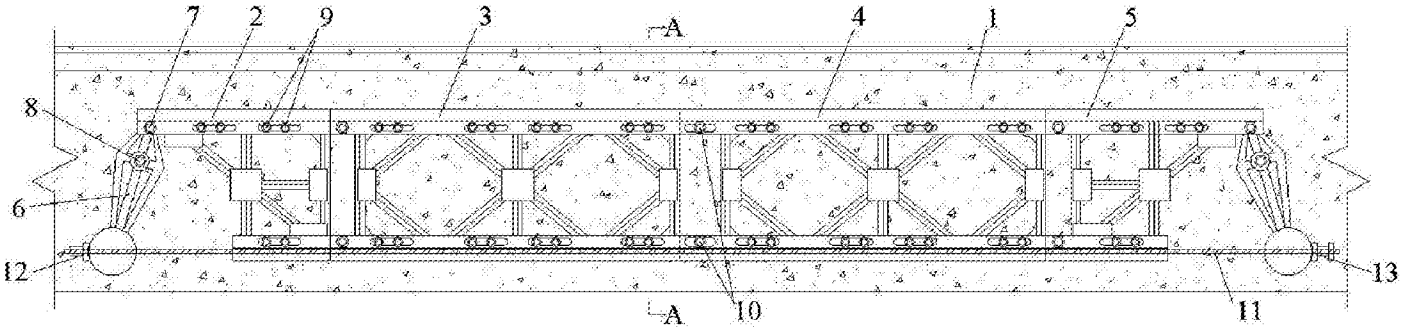
FIG. 1 is a schematic diagram of a Bailey beam installed before prestress tensioning is performed according to the invention.

In the drawings: 1: T beam; 2: Bailey panel I; 3: Bailey panel II; 4: Bailey panel III; 5: Bailey panel IV; 6: Stiffening rod; 601: Cylinder; 7: Bolt; 8: First anchor bolt; 9: Second anchor bolt; 10: Third anchor bolt; 11: Prestressing tendon; 12: Fixing end anchorage; 13: Tensioning end anchorage;

14: Nut; 15: Sealing steel plate; 16: Cement paste; 17: Upper chord; 18: Lower chord; 19: Web member; 20: Male end; 21: Female end.

DESCRIPTION OF THE EMBODIMENTS

Referring to FIG. 1 to FIG. 9, a middle Bailey panel set in this embodiment includes a pair of Bailey panels. In actual use, the middle Bailey panel set may include a plurality of pairs of Bailey panels as needed. For ease of description, a front Bailey panel is referred to as a Bailey panel I 2, an end Bailey panel is referred to as a Bailey panel IV 5, a Bailey panel that is in the middle Bailey panel set and close to the front Bailey panel is referred to as a Bailey panel II 3, and the other Bailey panel is referred to as a Bailey panel III 4. In addition, to be distinguished by name, anchor bolts used to fix stiffening rods, anchor bolts used to fix all Bailey panels, and anchor bolts used to connect two Bailey panels in the middle are respectively referred to as the first anchor bolts 8, the second anchor bolts 9, and the third anchor bolts 10.

Figure 2:
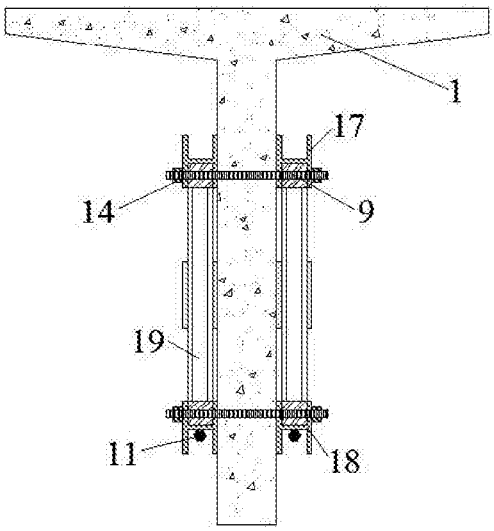
FIG. 2 is a sectional view taken along line A-A in FIG. 1 according to the invention.
Figure 3:
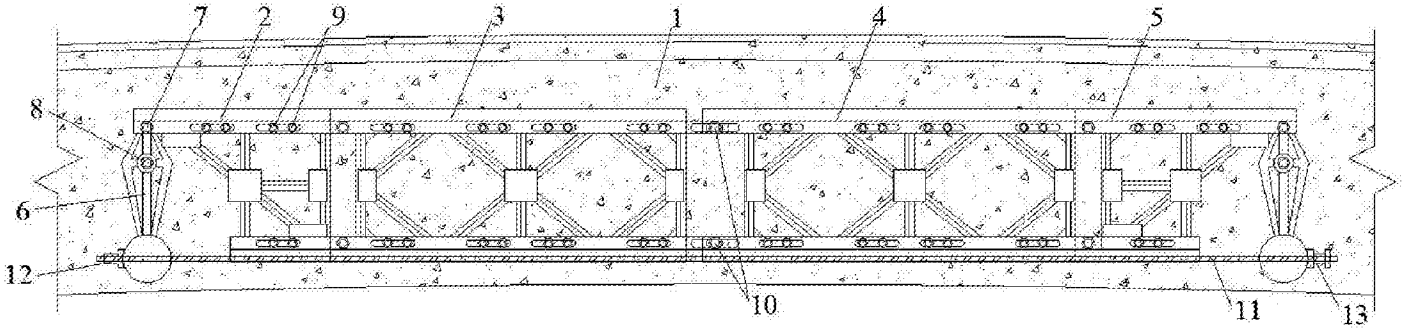
FIG. 3 is a schematic diagram of prestress tensioning and anchoring being completed according to the invention.
Figure 4:
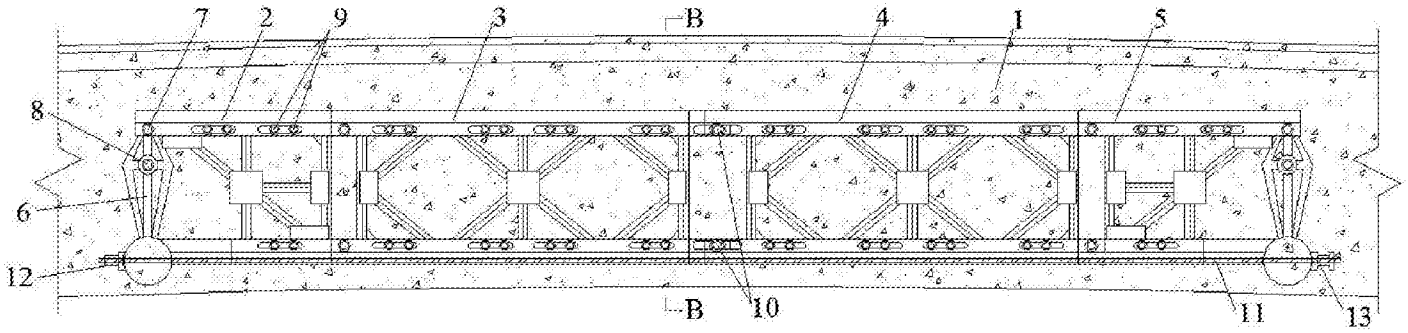
FIG. 4 is an overall schematic diagram of a prestressed Bailey beam reinforcing a T beam according to the invention.
Figure 5:
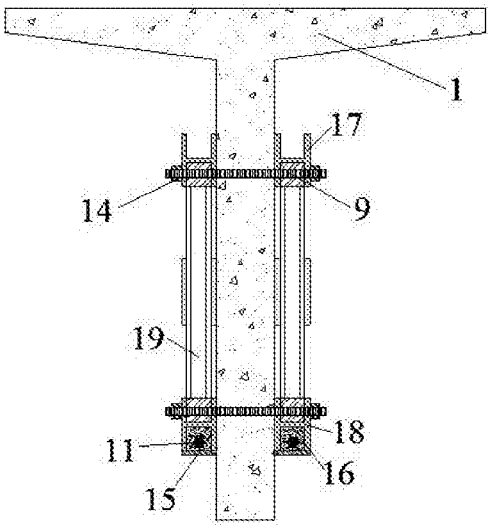
FIG. 5 is a sectional view taken along line B-B in FIG. 4 according to the invention.
Figure 6:
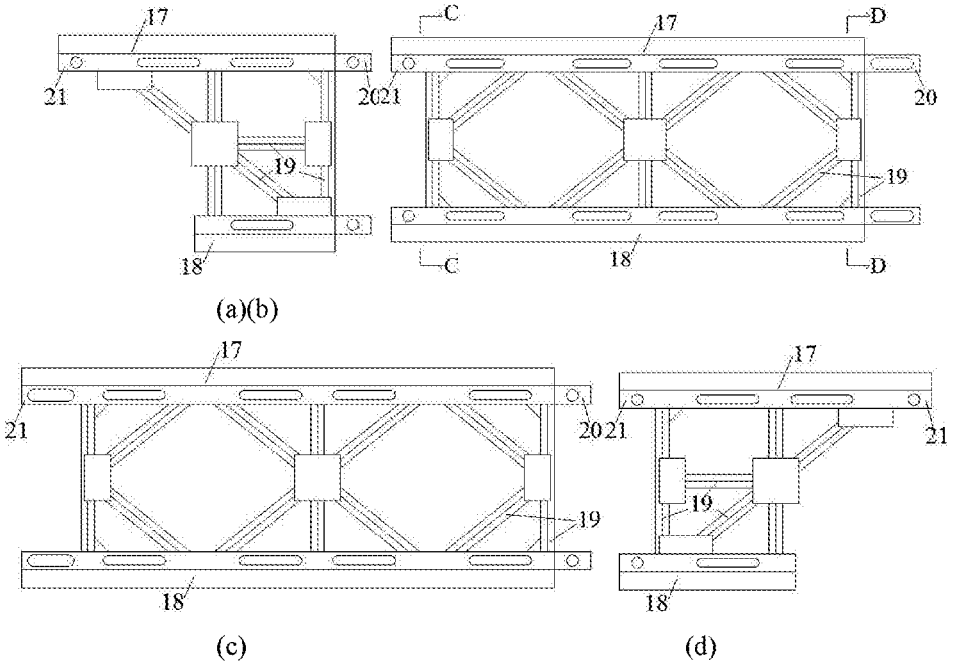
FIG. 6 is a schematic diagram of all Bailey panels of a prestressed Bailey beam according to the invention, where (a) is a structural diagram of a Bailey panel I, (b) is a structural diagram of a Bailey panel II, (c) is a structural diagram of a Bailey panel III, and (d) is a structural diagram of a Bailey panel IV.
Figure 7:
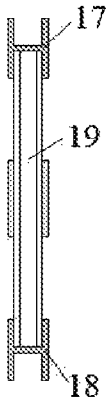
FIG. 7 is a sectional view taken along line C-C in FIG. 6 according to the invention.
Figure 8:
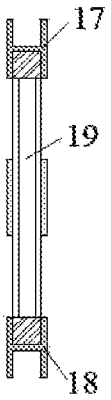
FIG. 8 is a sectional view taken along line D-D in FIG. 6 according to the invention.
Figure 9:
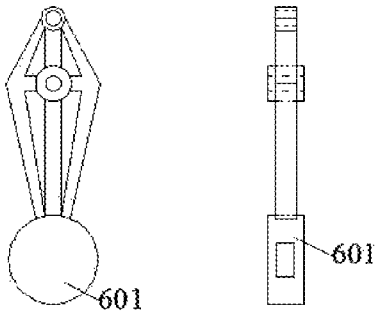
FIG. 9 is a structural diagram of a stiffening rod according to the invention.

The components of the Bailey beam are all prefabricated in a factory, and are assembled and hoisted on site. In FIG. 1 and FIG. 2, the Bailey beam is assembled on site by using bolts and are symmetrically installed on both sides of a structure to be strengthened. In this embodiment, the structure to be strengthened is a T beam. In actual use, the structure to be strengthened may also be a box beam, a rectangular beam, a plate, a wall, or the like. The Bailey panel I 2, the Bailey panel II 3, the Bailey panel III 4, and the Bailey panel IV 5 are connected by using bolts 7 and tightened by using nuts 14. A male end of the Bailey panel II and a female end of the Bailey panel III are both provided with an elongated sliding groove for the third anchor bolt to pass therethrough. The Bailey panel II 3 and the Bailey panel III 4 are connected by using the third anchor bolt 10. The second anchor bolt 9 passes through the elongated sliding grooves on all Bailey panels and anchors the Bailey panels onto the T beam 1. The stiffening rod 6 functions as a lever to transmit the prestress, is provided with a screw hole for the bolt 7 to pass therethrough, and is connected to female ends 21 of the Bailey panel I 2 and the Bailey panel IV 5 by using the bolts 7. The first anchor bolt 8 passes through the screw hole in the middle of the stiffening rod 6 and anchors the stiffening rod 6 onto the T beam 1. During prestress tensioning, the first anchor bolt 8 functions as a fulcrum of a lever, and a lower end of the stiffening rod 6 is a cylinder 601 provided with an elongated sliding groove. The prestressing tendon 11 passes through a cylinder 601 on one end of the stiffening rod 6, a lower chord 18 of the Bailey panel, and a cylinder 601 on the other end of the stiffening rod 6. In FIG. 3 to FIG. 5, the prestressing tendon 11 is tensioned by a jack, and is anchored onto the cylinder 601 on the lower end of the stiffening rod 6 by using a fixing end anchorage 12 and a tensioning end anchorage 13. During prestress tensioning, the tensioning end anchorage and the fixing end anchorage can slide along an outer wall of the cylinder 601, enabling the prestressing tendon 11 to keep a shape of a straight line. After the prestress tensioning is completed, the Bailey beam is fixed by tightening nuts 14 and is anchored onto the T beam 1. H-shaped steels serving as fillers are fixed respectively between the cylinder 601 of the stiffening rod 6 and the lower chord 18 of the Bailey panel I, between the cylinder 601 of the stiffening rod 6 and the lower chord 18 of the Bailey panel IV, and between the female end 21 of the Bailey panel III 4 and a chord of the Bailey panel II 3 by means of welding. A sealing steel plate 15 is welded onto an opening of the prestressing groove on the lower chord 18 of the Bailey panel so as to form a sealed rectangular steel tube. Finally, the cement paste 16 is used as a solidifiable material, which is injected into the steel tube so as to form a composite structure of the prestressed concrete filled steel-tubular.

The Bailey beam slides towards both ends during prestress tensioning. After the tensioning is completed, the anchor bolts are tightened so as to anchor the Bailey beam onto the structure to be strengthened. Then the H-shaped steels serving as fillers are welded respectively between the cylinder of the stiffening rod and the lower chord of the Bailey panel I, between the cylinder of the stiffening rod and the lower chords of the Bailey panel IV, and onto the female end of the Bailey panel III. During the prestress tensioning, the stiffening rod is driven to rotate around the first anchor bolt, transmit the prestress to the Bailey beam and drive the Bailey beam to slide towards both ends. Then the Bailey beam turns the prestress into a vertical force and transmits the vertical force to the structure through the anchor bolts.

The Bailey beam includes an even number of Bailey panels, and the number is no less than 4. The Bailey panels are symmetrically arranged along a center of the reinforced region. The specific number and size of the Bailey panels should be based on the size of the reinforced structure and the range of the reinforced region. In this embodiment, the Bailey panel uses an H-shaped steel rather than a channel steel as an upper chord and a lower chord, so as to form a prestressing tendon groove.

The prestressing tendon is arranged in the lower chord. After the prestress tensioning is completed, a sealing steel plate is welded at a lower side of the H-shaped steel and a grouting port is reserved. Then cement paste or a structural adhesive is injected so as to form a composite structure of the prestressed concrete filled steel-tubular. In this case, the Bailey beam and the prestressing tendon bear weight jointly, stiffness of the components is enhanced, a prestress loss is reduced, and the prestressing tendon is protected.

After tensioning is completed, the prestressing tendon implements self-anchorage on the cylinder of the stiffening rod and does not cause local cracking of the concrete member.

The specific working process is shown as follows. Step 1: Prefabricate the Bailey panel I 2, the Bailey panel II 3, the Bailey panel III 4, the Bailey panel IV 5, and the stiffening rods 6 in a factory. Step 2: Determine positions of the anchor bolts on a surface of the reinforced region of the T beam 1, drill holes and insert the anchor bolts. Step 3: The prefabricated Bailey panels and the stiffening rods 6 are assembled at the construction site by using the bolts 7, and hoisted in place by using hoisting equipment, where the first anchor bolt 8 passes through the screw hole in the middle of the stiffening rod 6 and functions as a fulcrum of a lever, the second anchor bolt 9 passes through the elongated sliding groove on the upper chord 17 and the lower chord 18 of the Bailey panel, the third anchor bolt 10 passes through the male end 20 of the Bailey panel II 3 and the female end 21 of the Bailey panel III 4, and the nuts 14 are not excessively tightened, so as to ensure that the stiffening rod 6 can rotate and the Bailey frame can slide towards both ends during the prestress tensioning. Step 4: Pass the prestressing tendon 11, and perform tensioning and anchoring by using the jack and the anchorages, so that during the prestress tensioning, the stiffening rod 6 rotates around the first anchor bolt 8, transmits the prestress to the Bailey beam and drives the Bailey beam to slide towards both ends, and then turns the prestress into a vertical force and transmits the vertical force to the structure by using the anchor bolts. The force transmission path is: the anchorages→the stiffening rods→the first anchor bolt and the Bailey beam→the second anchor bolt and the third anchor bolt→the T beam. Step 5: After the prestress tensioning is completed, fix the Bailey beam by tightening the nuts 14, anchor the Bailey beams onto the T beam 1, and then weld the H-shaped steel and the sealing steel plate 15, so that a sealed rectangular steel tube is formed at the lower side of the H-shaped steel of the lower chord 18 of the Bailey beam. Step 6: Inject the cement paste 16 or the structural adhesive into the steel tube.

The foregoing descriptions are merely for illustration of the invention, but are not intended to limit the technical solution in the invention. Any improvement, replacement, or the like made within the principle of the invention shall fall within the protection scope of the invention.

What is claimed is:

1. A prestressed Bailey beam for reinforcement, comprising Bailey panels, anchor bolts, two stiffening rods, bolts, nuts and a prestressing tendon, wherein the Bailey panels comprise a front Bailey panel, an end Bailey panel, and a middle Bailey panel set, all Bailey panels are linked end-to-end in sequence, the front Bailey panel and the end Bailey panel are installed on both ends of the prestressed Bailey beam respectively, the middle Bailey panel set is installed between the front Bailey panel and the end Bailey panel and a number of the middle Bailey panel is n pairs, wherein n is a natural number, a plurality of elongated sliding grooves are formed at both an upper chord and a lower chord of each of the Bailey panels, the anchor bolts pass through the elongated sliding grooves and are fixed on a structure to be strengthened, the two stiffening rods are disposed on the front Bailey panel and the end Bailey panel respectively, one end of each of the stiffening rods is connected to the upper chord of the front Bailey panel and end Bailey panel respectively through a corresponding one of the bolts, each of the anchor bolts passes through a central position of a respective stiffening rod and is fixed on the structure to be strengthened so as to function as a fulcrum for each respective stiffening rod to rotate, an anchorage is disposed at the other end of each of the stiffening rods, the prestressing tendon passes through the two anchorages on the two stiffening rods, and the nuts are screwed into the anchor bolts and are tightened to fix positions of the Bailey panels after completion of tensioning of the prestressing tendon.

2. The prestressed Bailey beam for reinforcement according to claim 1, wherein a cylinder is disposed on each of the stiffening rods at the other end where each anchorage is disposed, an elongated prestressing tendon groove passing entirely through each cylinder is formed in a diameter direction of a cross section of each cylinder, each anchorage is attached on a side wall of a respective cylinder by an acting force of the prestressing tendon, and the prestressing tendon passes through the prestressing tendon groove on the cylinder of each of the stiffening rods.

3. The prestressed Bailey beam for reinforcement according to claim 1, wherein a prestressing groove, which has an opening at a side and is used to accommodate the prestressing tendon, is formed at a bottom of the lower chord of each of the Bailey panels.

4. The prestressed Bailey beam for reinforcement according to claim 3, further comprising a sealing steel plate and a solidifiable material, a size of the sealing steel plate matches a size of the opening of the prestressing groove, and after the tensioning of the prestressing tendon is completed, the sealing steel plate is fixed on the opening of the prestressing groove, so that the prestressing groove is turned into a tubular structure and the solidifiable material is injected into the tubular structure and is solidified thereinside.

5. The prestressed Bailey beam for reinforcement according to claim 4, wherein the solidifiable material is cement paste or a structural adhesive.

6. The prestressed Bailey beam for reinforcement according to claim 1, wherein the Bailey beam is installed on two sides of the structure to be strengthened, the Bailey beams on the two sides are symmetrically installed, and the anchor bolts pass through the structure to be strengthened and are used to fix the Bailey beams on the two sides.

7. The prestressed Bailey beam for reinforcement according to claim 1, wherein two of the Bailey panels located at a central position of the middle Bailey panel set are respectively provided with female ends and male ends in a prestress stretching direction on a connecting side of the two Bailey panels for mutual connection, the female ends are formed on the upper chord and the lower chord of one of the two Bailey panels, the male ends are formed on the upper chord and the lower chord of the other one of the two Bailey panels, and the female end and a corresponding male end are overlapped and are provided with overlapping elongated sliding grooves for the anchor bolt to pass therethrough.

8. The prestressed Bailey beam for reinforcement according to claim 7, further comprising a plurality of fillers in a same shape as the upper chord and the lower chord, wherein a gap is reserved between one of the stiffening rods and the lower chord of the front Bailey panel, a gap is reserved between the other one of the stiffening rods and the lower chord of the end Bailey panel, and after completion of the tensioning of the prestressing tendon, a corresponding one of the fillers is fixed between the one of the stiffening rods and the lower chord of the front Bailey panel, a corresponding one of the fillers is fixed between the other one of the stiffening rods and the lower chord of the end Bailey panel, and a corresponding one of the fillers is fixed in a gap stretching between the female end and the male end of the two Bailey panels located at the central position of the middle Bailey panel set.

9. The prestressed Bailey beam for reinforcement according to claim 1, wherein aside from a connection part of two of the Bailey panels located at a central position, any two neighboring Bailey panels are respectively provided with female ends and male ends in a prestress stretching direction on a connecting side of the two neighboring Bailey panels for mutual connection, the female ends are formed on the upper chord and the lower chord of one of the two neighboring Bailey panels, the male ends are formed on the upper chord and the lower chord of the other one of the two neighboring Bailey panels, and the female end and a corresponding male end are overlapped and are provided with overlapping fixing holes for a bolt to pass therethrough to fixedly connect the two neighboring Bailey panels.

10. The prestressed Bailey beam for reinforcement according to claim 1, wherein the anchorage includes a tensioning end anchorage and a fixing end anchorage respectively disposed at the two stiffening rods.

11. A construction method adapted for a prestressed Bailey beam for reinforcement, the method comprising the following steps:

step 1: providing Bailey panels, anchor bolts and two stiffening rods, wherein the Bailey panels comprise a front Bailey panel, an end Bailey panel, and a middle Bailey panel set;

step 2: determining positions of the anchor bolts on a surface of a to-be-reinforced region of a concrete structure, drilling holes and inserting the anchor bolts;

step 3: hoisting and mounting the Bailey panels and the stiffening rods to the positions of the anchor bolts, wherein all Bailey panels are linked end-to-end in sequence, the front Bailey panel and the end Bailey panel are installed on both ends of the prestressed Bailey beam respectively, the middle Bailey panel set is installed between the front Bailey panel and the end Bailey panel, the two stiffening rods are disposed on the front Bailey panel and the end Bailey panel respectively, one end of each of the stiffening rods is connected to an upper chord of the front Bailey panel and end Bailey panel respectively through corresponding bolts, each of the anchor bolts passes through a central position of a respective stiffening rod and is fixed on the concrete structure so as to function as a fulcrum for each respective stiffening rod to rotate; and screwing nuts into the anchor bolts while ensuring that the stiffening rods are rotatable and the Bailey panels can slide towards both ends during prestress tensioning;

step 4: passing a prestressing tendon through a cylinder of one of the stiffening rods, a lower chord of each of the Bailey panels, and a cylinder on the other one of the stiffening rods, in sequence; performing tensioning on the prestressing tendon by using tension equipment; and after the tensioning is completed, tightening the nuts to fix the stiffening rods and the Bailey panels; and anchoring the prestressing tendon onto the cylinders of the stiffening rods by using a tensioning end anchorage and a fixing end anchorage;

step 5: after the prestress tensioning is completed, fixing a filler between one of the stiffening rods and the lower chord of the front Bailey panel, fixing a filler between the other one of the stiffening rods and the lower chord of the end Bailey panel, and fixing a filler between female ends and male ends of two Bailey panels located at a central position, so as to make the Bailey panels and the stiffening rods a fixed whole; and fixing a sealing steel plate on an opening of a prestressing groove so as to form a sealed rectangular steel tube; and step 6: injecting a solidifiable material into the steel tube.

* * * * *